US007682003B2

(12) United States Patent
Ito

(10) Patent No.: US 7,682,003 B2
(45) Date of Patent: Mar. 23, 2010

(54) NEEDLE AND METHOD OF MANUFACTURING THEREOF

(75) Inventor: Atsushi Ito, Owariasahi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 753 days.

(21) Appl. No.: 11/456,149

(22) Filed: Jul. 7, 2006

(65) Prior Publication Data

US 2007/0019048 A1 Jan. 25, 2007

(30) Foreign Application Priority Data

Jul. 11, 2005 (JP) ..... 2005-202046

(51) Int. Cl.
*B41J 2/175* (2006.01)

(52) U.S. Cl. ..... 347/84; 347/85; 347/86

(58) Field of Classification Search ..... 347/85, 347/86, 84

See application file for complete search history.

(56) References Cited

U.S. PATENT DOCUMENTS 5,971,533 A * 10/1999 Kinoshita et al. ..... 347/86
2005/0157109 A1 7/2005 Muranaka et al.

FOREIGN PATENT DOCUMENTS

| | | | |
|---|---|---|---|
| JP | H05-084924 A | | 4/1993 |
| JP | 11207982 A | * | 8/1999 |
| JP | H11 207982 | | 8/1999 |
| JP | 2005 14437 | | 1/2005 |

OTHER PUBLICATIONS

Japan Patent Office, Notification of Reasons for Rejection in priority Patent Application No. JP 2005-202046, mailed Aug. 26, 2008.

* cited by examiner

*Primary Examiner*—Manish S Shah
*Assistant Examiner*—Laura E Martin
(74) *Attorney, Agent, or Firm*—Baker Botts L.L.P.

(57) ABSTRACT

A needle is provided with a tubular member. The tubular member comprises a side wall, a through hole formed at the side wall, and an outer slanted portion formed at an outer surface of the side wall along the periphery of the through hole. The outer slanted portion slants down toward the through hole. A length of the outer slanted portion in an axis direction of the tubular member is greater than a length of the outer slanted portion in a circumferential direction of the tubular member.

17 Claims, 6 Drawing Sheets

(a)

(b)

NEEDLE AND METHOD OF MANUFACTURING THEREOF

CROSS-REFERENCE TO RELATED APPLICATION

This application claims priority to Japanese Patent Application No. 2005-202046, filed on Jul. 11, 2005, the contents of which are hereby incorporated by reference into the present application.

BACKGROUND OF THE INVENTION

1. Field of the Invention

The present invention relates to a tubular needle and a method of manufacturing the needle. For example, the needle according to the present invention can be utilized for communicating inside to outside of a liquid housing body by penetrating an elastic body which blocks an opening of the liquid housing body. For example, the needle according to the present invention can be utilized for penetrating an elastic body which blocks an opening of an ink cartridge.

2. Description of the Related Art

Japanese Patent Application Publication NO.2005-14437 discloses an ink jet printer. This ink jet printer has an ink jet head for discharging ink toward a printing medium, a space for housing an ink cartridge, and a needle which is located at a position facing the space. The needle has a tubular member. The tubular member dwindles toward one end. A through hole is formed on a side wall of the tubular member.

The ink cartridge has an elastic body which blocks an opening. When the ink cartridge is housed in the space, the needle penetrates the elastic body. Ink in the ink cartridge passes through the inside of the needle via the through hole of the needle. The ink which passes through the inside of the needle is sent to the ink jet head.

When the needle penetrates the elastic body, the elastic body expands toward the needle. In this case, the elastic body may reach the inside of the through hole. When the needle moves with respect to the elastic body in the state where the elastic body has reached the inside of the through hole, the elastic body interferes with an inner surface of the through hole. As a result, the elastic body may be peeled off by the inner surface of the through hole.

In FIG. 5 of Japanese Patent Application Publication NO.11-207982, a needle with the following configuration is disclosed. This needle has an outer slanted portion formed on an outer surface of a tubular member along the periphery of a through hole. The outer slanted portion slants down toward the through hole. This document discloses that the outer slanted portion is circular.

In this needle, the outer slanted portion is formed along the periphery of the through hole. In this case, when the needle moves with respect to the elastic body, the outer slanted portion pushes back the elastic body toward a side opposite to the needle. Thus, the elastic body which has reached the inside of the through hole is pushed back in a direction away from the through hole. For this reason, even when the needle moves with respect to the elastic body in the state where the elastic body has reached the inside of the through hole, it may be possible to avoid the elastic body from interfering with the inner surface of the through hole. Therefore, it is possible to make it harder for the elastic body to be peeled of by the inner surface of the through hole.

BRIEF SUMMARY OF THE INVENTION

This specification discloses a needle with new configuration which is not disclosed in the above-mentioned documents. In the needle disclosed in this specification, a good scheme is given to configuration of an outer slanted portion. That is, a length of the outer slanted portion in an axis direction of a tubular member is greater than a length of the outer slanted portion in a circumferential direction of the tubular member.

By moving in the axis direction with respect to an elastic body, the needle penetrates the elastic body. When the needle moves with respect to the elastic body in the axis direction, the outer slanted portion pushes back the elastic body in a direction opposite to the needle. In the needle in this embodiment, the outer slanted portion is formed to be long in the axis direction of the tubular member. Thus, when the needle moves with respect to the elastic body in the axis direction, the outer slanted portion can effectively push back the elastic body.

As the tubular member becomes thinner, the strength in the circumferential direction tends to decrease. The outer slanted portion of the needle in this embodiment is formed to be short in the circumferential direction of the tubular member. Even when the outer slanted portion is formed on the tubular member, it is possible to prevent the strength of the tubular member in the circumferential direction from greatly lowering.

BRIEF DESCRIPTION OF THE DRAWINGS

FIG. 7(*a*) shows the state where the cap does not reach the outer slanted portion. FIG. 7(*b*) shows the state where the cap reaches the outer slanted portion.

DETAILED DESCRIPTION OF THE INVENTION

Embodiment

Figure 1:
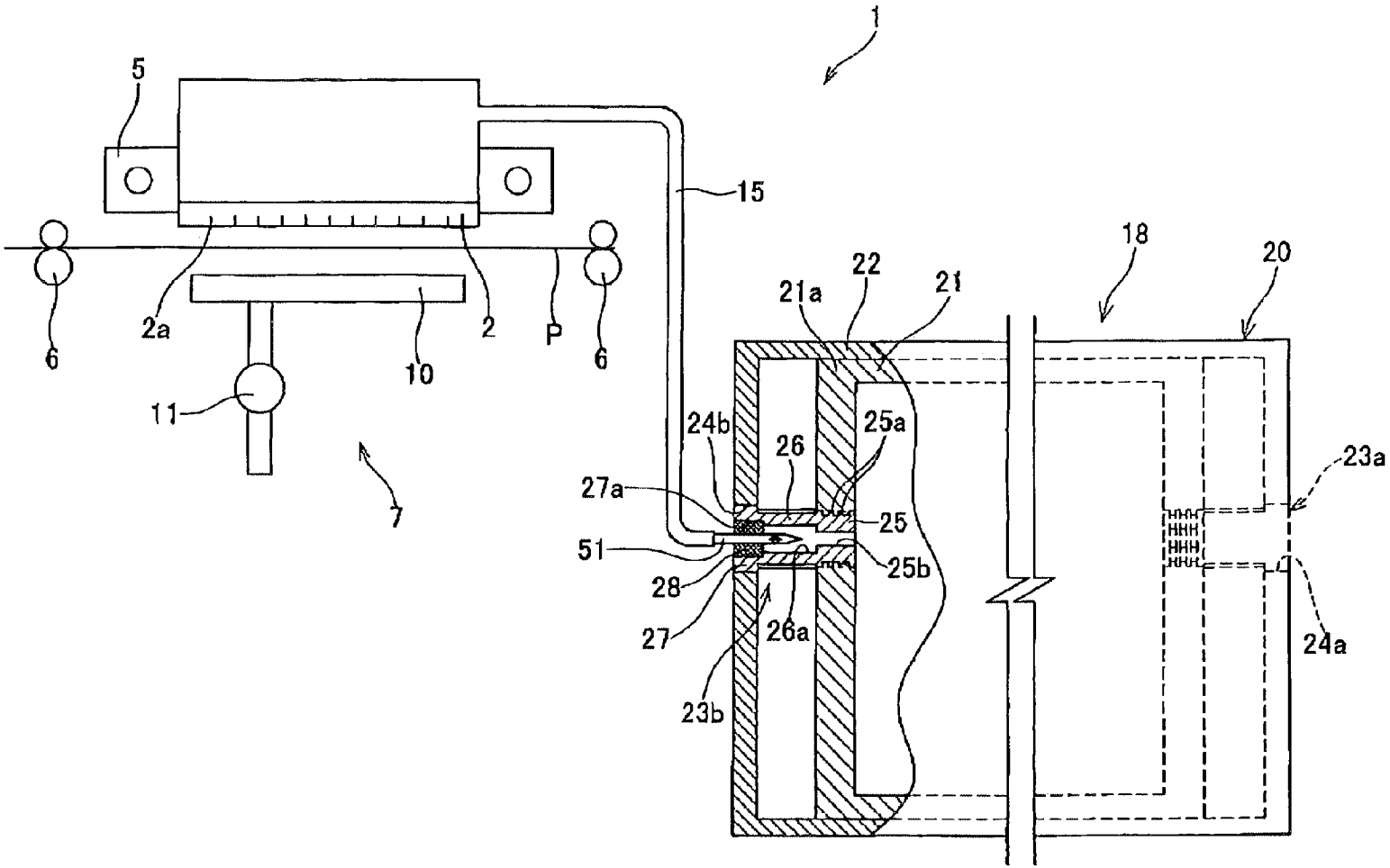
FIG. 1 shows a schematic view of an ink jet printer of an embodiment.

FIG. 1 shows a schematic view of an ink jet printer 1. The ink jet printer 1 has an ink jet head 2, a carriage 5, a conveyance mechanism 6 and a purge device 7. The ink jet head 2 has a nozzle 2*a* for discharging ink toward a recording sheet P. The carriage 5 transfers the ink jet head 2 in a direction which is perpendicular to a sheet of FIG. 1. The conveyance mechanism 6 conveys the recording sheet P in the horizontal direction in FIG. 1. The purge device 7 sucks air and high viscous ink in the ink jet head 2.

The ink jet printer 1 has a space 18 for housing an ink cartridge 20. The ink cartridge 20 is disposed in the space 18. The ink cartridge 20 can be attached to or removed from the ink jet printer 1. The ink cartridge 20 stores the ink therein.

The ink jet printer 1 has a needle 51 and a tube 15. The needle 51 is disposed at a position facing to the space 18. One end of the tube 15 is connected to the needle 51. The other end of the tube 15 is connected to the ink jet head 2. The ink cartridge 20 is in fluid communication with the ink jet head 2 through the needle 51 and the tube 15. The ink in the ink cartridge 20 is supplied to the ink jet head 2 via the needle 51 and the tube 15.

In performing printing on the recording sheet P, the ink jet head 2 is reciprocated by the carriage 5 in the direction which is perpendicular to the sheet of FIG. 1, and the recording sheet P is conveyed by the conveyance mechanism 6 in the horizontal direction in FIG. 1. The reciprocation of the ink jet head 2 and the conveyance of the recording sheet P are simultaneously performed by a controller (not shown). When the ink jet head 2 runs across the recording sheet P, the ink is discharged from the nozzle 2*a*.

The purge device 7 is disposed below the ink jet head 2. The purge device 7 has a purge cap 10 and a pump 11. The purge cap 10 can cover a lower surface of the ink jet head 2 (a surface on which the nozzle 2*a* is formed). The pump 11 can suck the ink from the nozzle 2*a* The pump 11 operates in the state where the purge cap 10 covers the lower surface of the ink jet head 2. Thus, air and high viscous ink in the ink jet head 2 are sucked from the nozzle 2*a*. This purge operation recovers an ink discharge ability of the ink jet head 2.

The ink cartridge 20 has an ink bag 21, a housing 22 and a pair of spouts 23*a*, 23*b*. The ink bag 21 houses deaerated ink. The ink bag 21 is formed symmetrically in right-left direction of FIG. 1. The ink bag 21 is made of a resin film with laminated structure. The resin film is formed by thermally compressing a plurality of flexible films. The resin film has a structure in which a polypropylene layer, a polyester layer, an alumina layer, and a nylon layer are laminated from the inner side in this order. The polyester layer functions as a base layer. The alumina layer functions as a gas barrier layer. A silica evaporated layer may be adopted in place of the alumina layer. The nylon layer increases the strength of the film.

Peripheries 21*a* of a pair of resin films are thermally compressed with welded portions 25 of the spouts 23*a*, 23*b* being sandwiched therebetween. This produces the ink bag 21 in which the periphery 21*a* is connected to the spouts 23*a*, 23*b*.

The housing 22 houses the ink bag 21. The housing 22 is made of synthetic resin. The housing 22 has an ink supply port 24*a* and an ink discharge port 24*b*.

The pair of spouts 23*a*, 23*b* is made of resin. One spout 23*a* is disposed on the right side of the ink bag 21. The spout 23*a* is located at a position corresponding to the ink supply port 24*a*. An ink injector, not shown, supplies the ink to the ink bag 21 via the spout 23*a*. The other spout 23*b* is disposed on the left side of the ink bag 21. The spout 23*b* is located at a position corresponding to the ink discharge port 24*b*. The ink in the ink bag 21 is sent to the ink cartridge 2 through the spout 23*b*. The pair of spouts 23*a* and 23*b* has the same configuration. Hereinafter, configuration of the spout 23*b* will be described in detail. Description of the configuration of the spout 23*a* is omitted.

The spout 23*b* is formed to be cylindrical as a whole. The spout 23*b* has the welded portion 25, a trunk portion 26 and a support portion 27.

The welded portion 25 is a portion thermally welded to the periphery 21*a* of the ink bag 21. A plurality of protrusions 25*a* is formed on the outer side surface of the welded portion 25. The periphery 21*a* of the ink bag 21 is thermally welded so as to enter into the protrusions 25*a*. In this manner, the ink bag 21 is integrated with the spout 23*b*. This ensures sealing between the ink bag 21 and the spout 23*b*. The welded portion 25 has a hole 25*b* communicating to the inside of the ink bag 21.

The trunk portion 26 is a portion connecting the welded portion 25 to the support portion 27. The trunk portion 26 has a hole 26*a* communicating to the hole 25*b* of the welded portion 25. The diameter of the hole 26*a* is larger than the diameter of the hole 25*b*.

The support portion 27 is a portion supported by the housing 22. The support portion 27 has a hole 27*a* communicating to the hole 26*a* of the trunk portion 26. The diameter of the hole 27*a* is larger than the diameter of the hole 26*a*. A cap 28 is fitted into the hole 27*a*. The cap 28 closes the hole 27*a*. Unless the needle 51 described later penetrates the cap 28, the ink in the ink bag 21 is not discharged to the outside across the cap 28. It can be said that the cap 28 blocks the ink discharge port 24*b* of the ink cartridge 20. The cap 28 is an elastic member. For example, the cap can be made of silicon rubber or butyl rubber.

The needle 51 can penetrate the cap 28. Thus, the ink in the ink bag 21 is sent to the ink jet head 2 through the needle 51 and the tube 15. When it runs short of the ink in the ink cartridge 20, the ink cartridge 20 can be removed from the ink jet printer 1 by pulling the needle 51 out of the cap 28. Then a new ink cartridge 20 may be attached to the ink jet printer 1.

Figure 2:
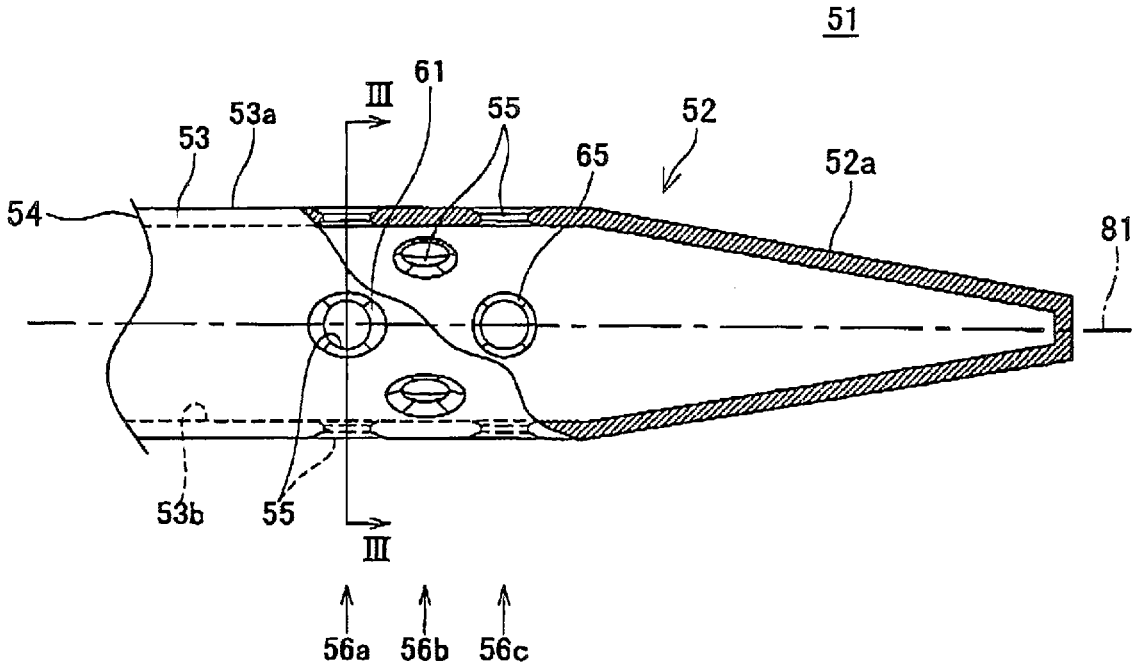
FIG. 2 shows a part of a needle.

Next, configuration of the needle 51 will be described. FIG. 2 is a part of the needle 51. In FIG. 2, a left half of the needle 51 is shown in a front view and a right half is shown in a sectional view.

The needle 51 has a tubular member 52. One end (a right end in FIG. 2) of the tubular member is closed. A vertical cross-section of the tubular member 52 (for example, a cross-section of a III-II line in FIG. 2) is circular. The tubular member 52 has a taper portion 52*a* and a cylindrical portion 53. The taper portion 52*a* dwindles toward the right side in FIG. 2. The cylindrical portion 53 extends in an axis direction of the tubular member 52 (an axis direction of the needle 51). The axis of the taper portion 52*a* corresponds to the axis of the cylindrical portion 53.

The tubular member 52 has a plurality of through holes 55, a plurality of outer slanted portions 61, and a plurality of inner slanted portions 65.

Each of the through hole 55 penetrates a side wall 54 of the tubular member 52. In this embodiment, twelve through holes 55 are formed on the tubular member 52. Each of the through holes 55 is formed on the cylindrical portion 53. Each of the through holes 55 is not formed on the taper portion 52*a*.

Each of the outer slanted portions 61 is formed on an outer surface of the side wall 54. In this embodiment, twelve outer slanted portions 61 are formed on the tubular member 52. One outer slanted portion 61 corresponds to different one through hole 55. Each of the outer slanted portions 61 is formed on an outer side surface 53*a* of the cylindrical portion 53 along the periphery of the corresponding through hole 55. Each of the outer slanted portions 61 is not formed on the taper portion 52*a*.

Each of the inner slanted portions 65 is formed on an inner surface of the side wall 54. In this embodiment, twelve inner slanted portions 65 are formed on the tubular member 52. One inner slanted portions 65 corresponds to different one through hole 55. Each of the inner slanted portions 65 is formed on an inner side surface 53*b* of the cylindrical portion 53 along the periphery of the corresponding through hole 55. Each of the inner slanted portions 65 is not formed on the taper portion 52*a*.

Figure 3:
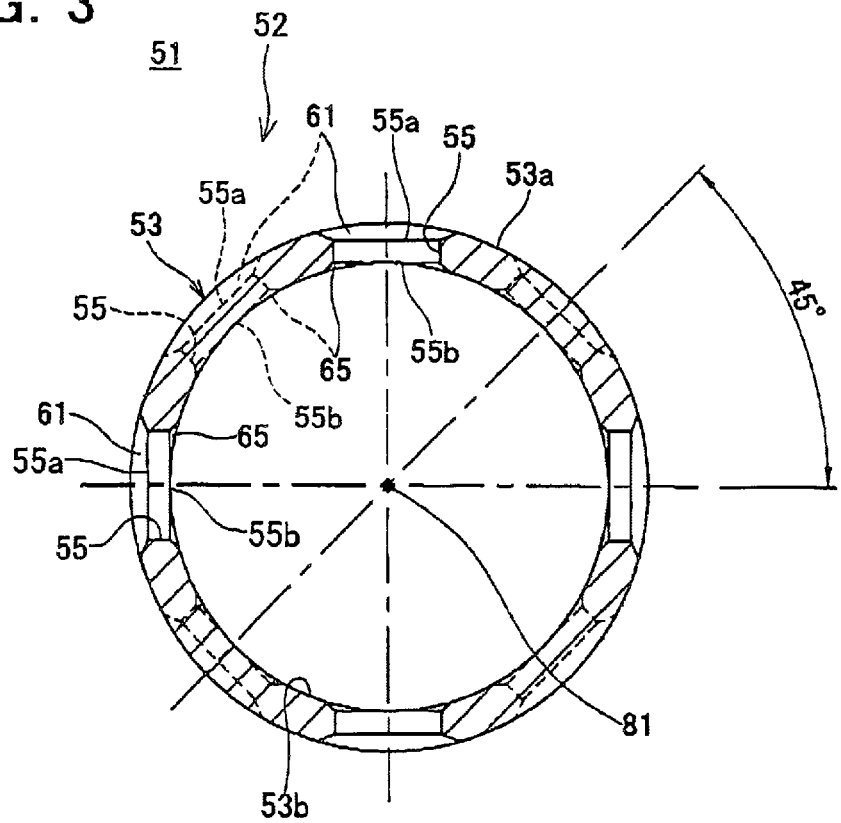
FIG. 3 shows a sectional view of a III-III line in FIG. 2.

FIG. 3 is a sectional view of a III-III line in FIG. 2. As seen from FIG. 3, four through holes 55 are formed at the same position in the axis direction of the tubular member 52 (the horizontal direction in FIG. 2). These four through holes 55 are arranged at 90-degree intervals. That is, the four through holes 55 are formed to be symmetrical with respect to the axis 81 of the tubular member 52 (the axis 81 of the needle 51). Hereinafter, the four through holes 55 formed at the same position in the axis direction of the tubular member 52 are referred to as a hole row.

In this embodiment, three hole rows 56*a*, 56*b* and 56*c* are arranged in the axis direction of the tubular member 52. As shown in FIG. 2, the hole row 56*a* is disposed at the leftmost position. The hole row 56*c* is disposed at the rightmost position. The hole row 56*b* is disposed between the hole row 56*a* and the hole row 56*c*. In the circumferential direction of the tubular member 52, the four through holes 55 of the hole row 56*a* and the four through holes 55 of the hole row 56*c* are located at the same position. On the other hand, in the circumferential direction of the tubular member 52, the four through holes 55 of the hole row 56*b* are shifted by 45 degrees with respect to the four through holes 55 of the hole row 56*a* (or the hole row 56*c*). This state is well represented in FIG. 3. In FIG. 3, the four through holes 55 of the hole row 56*a* are represented by solid lines. The four through holes 55 of the hole row 56*b* are represented by broken lines.

As shown in FIG. 3, one through hole 55, one outer slanted portion 61, and one inner slanted portion 65 correspond to each other. Each of the through holes 55 has an outer opening 55*a* which opens to the corresponding outer slanted portion 61. Each of the through holes 55 has an inner opening 55*b* which opens to the corresponding inner slanted portions 65. Each of the through holes 55 extends along a direction which is perpendicular to the axis 81 of the tubular member 52.

Each of the outer slanted portions 61 slants down toward the outer opening 55*a* of the corresponding through hole 55. Each of the inner slanted portions 65 slants down toward the inner opening 55*b* of the corresponding through hole 55.

Figure 4:
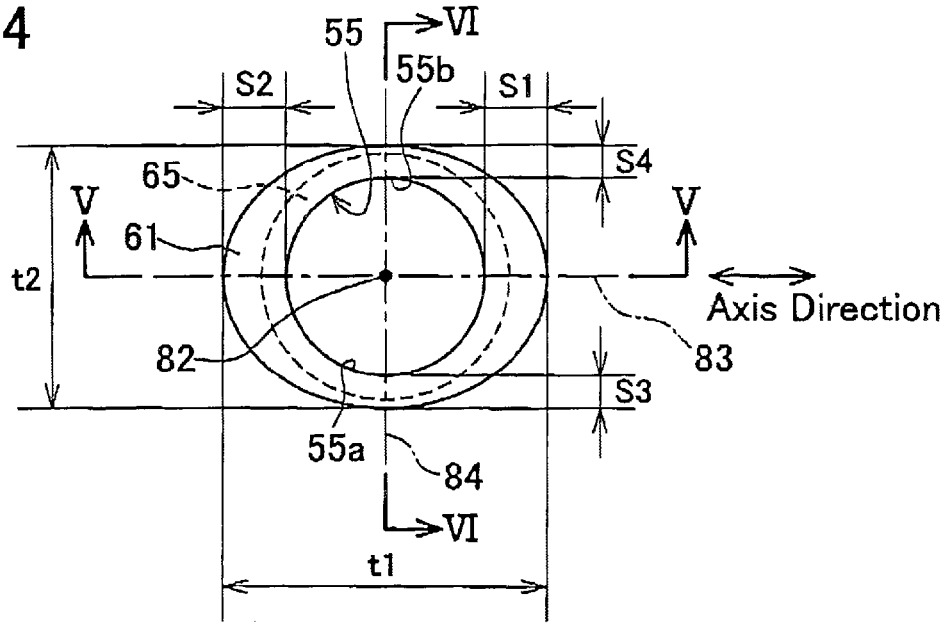
FIG. 4 shows a plan view of an outer slanted portion.

FIG. 4 shows a plan view of the outer slanted portion 61. FIG. 4 can be also referred to as a plan view of the outer opening 55*a*. When a line which passes through a center 82 of the outer opening 55*a* and is perpendicular to the axis 81 of the tubular member 52 (refer to FIG. 3) is defined as a predetermined line, FIG. 4 can be also referred to as a view of a plane perpendicular to the predetermined line.

The outer opening 55*a* and the inner opening 55*b* of the through hole 55 have the same circular shape. In FIG. 4, the center 82 of the outer opening 55*a* overlaps the center of the inner opening 55*b*.

The outer slanted portion 61 is formed over the periphery of the outer opening 55*a* of the through hole 55. The outer slanted portion 61 is formed in an elliptical shape which is long in the axis direction of the tubular member 52 (the horizontal direction in FIG. 4). That is, in FIG. 4, a length t1 is longer than a length t2. The outer opening 55*a* of the through hole 55 is disposed in the center of the outer slanted portion 61. That is, a distance S1 is equal to a distance S2, and a distance S3 is equal to a distance S4.

The inner slanted portion 65 is formed over the periphery of the inner opening 55*b* of the through hole 55. The inner slanted portion 65 has a circular shape larger than the outer opening 55*a* (or the inner opening 55*b*). The inner opening 55*b* of the through hole 55 is disposed in the center of the inner slanted portion 65.

In this embodiment, the center 82 of the outer opening 55*a* of the through hole 55, the center of the inner opening 55*b*, the center of the outer slanted portion 61, and the center of the inner slanted portion 65 are coaxially arranged.

A line which passes through the center 82 of the outer opening 55*a* and extends along the axis direction of the needle 51 (the horizontal direction in FIG. 4) is represented by a reference numeral 83. A line which passes through the center 82 of the outer opening 55*a* and extends in a direction which is perpendicular to the axis direction of the needle 51 in FIG. 4 (the vertical direction in FIG. 4) is represented by a reference numeral 84.

Each outer slanted portion 61 has an elliptical shape symmetrically with respect to both the lines 83 and 84. Within the plane in FIG. 4, a distance of a portion where the line 83 overlaps the outer slanted portion 61 is the sum of the distance S1 and the distance S2. Within the plane in FIG. 4, a distance of a portion where the line 84 overlaps the outer slanted portion 61 is the sum of the distance S3 and the distance S4. In this embodiment, the sum of the distance S1 and the distance S2 is greater than the sum of the distance S3 and the distance S4.

Figure 5:
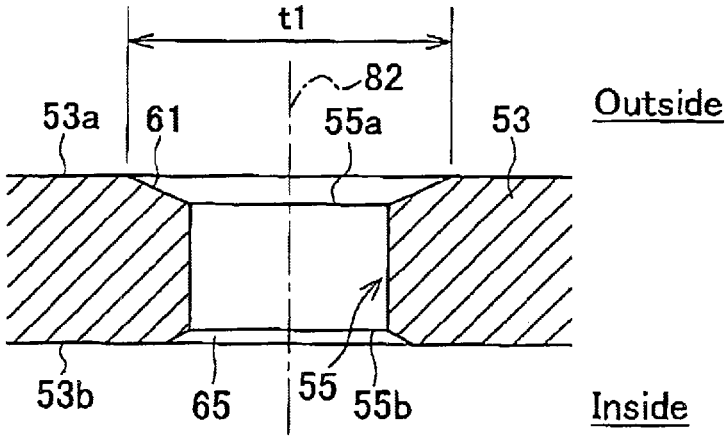
FIG. 5 shows a sectional view of a V-V line in FIG. 4.

FIG. 5 is a sectional view of a V-V line in FIG. 4. A depth of the outer slanted portion 61 is greater than a depth of the inner slanted portion 65.

Figure 6:
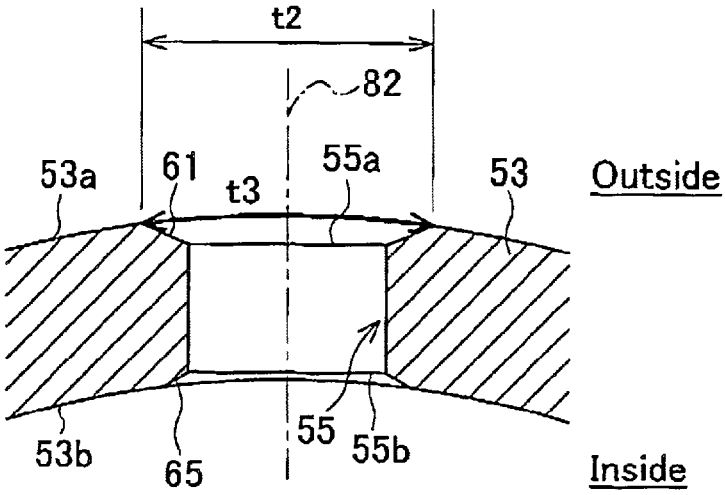
FIG. 6 shows a sectional view of a VI-VI line in FIG. 4.

FIG. 6 is a sectional view of a VI-VI line in FIG. 4. A length t3 is a length of the outer slanted portion 61 in the circumferential direction. The length t3 is a length of a circular arc with the axis 81 in FIG. 3 as a center. The length t3 is greater than the length t2. In this embodiment, the length t1 is greater than the length t3.

Figure 7:
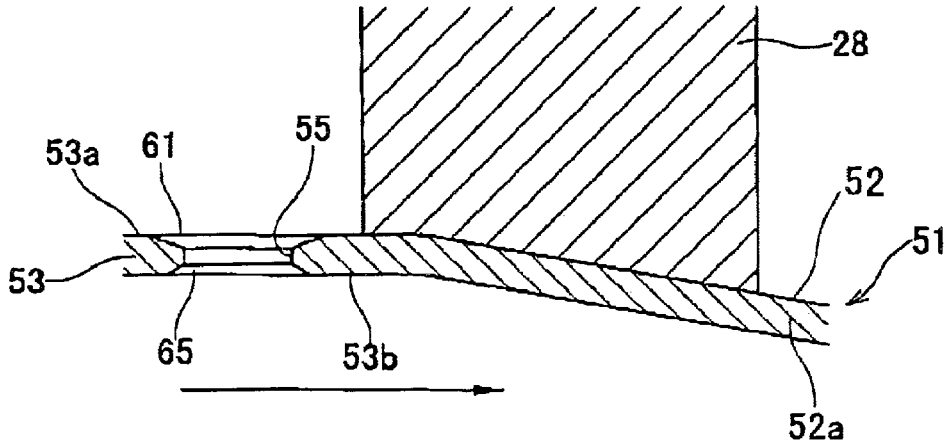
FIG. 7 shows the state where the needle sticks into a cap of an ink cartridge.
Figure 7:
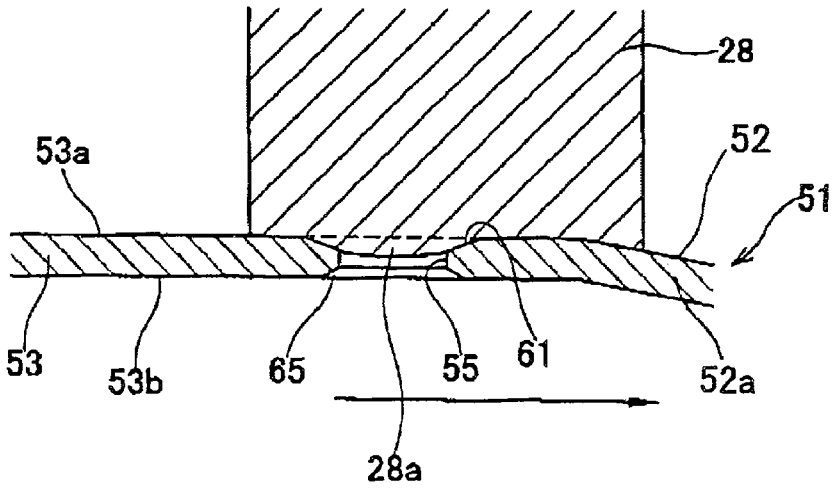

Next, the state where the needle 51 sticks into the cap 28 (refer to FIG. 1) will be described. FIG. 7(*a*) shows the state where the taper portion 52*a* of the needle 51 has stuck into the cap 28.

When the ink cartridge 20 is attached to the space 18 in the ink jet printer 1 (see FIG. 1), the taper portion 52*a* of the needle 51 sticks into the cap 28 of the ink cartridge 20. Since the taper portion 52*a* has a tapered shape, the taper portion 52*a* easily sticks into the cap 28. When the needle 51 sticks into the cap 28, the cap 28 is elastically deformed. A force with which the cap 28 is about to return to an original shape acts on the cap 28. This force is referred as an elastic rebound force.

In this embodiment, the through hole 55 is not formed on the taper portion 52*a*. In the case where the through hole is formed on the taper portion 52*a*, when the taper portion 52*a* sticks into the cap 28, a part of the cap 28 is easy to enter into the through hole due to the elastic rebound force. This is due to that the taper portion 52*a* slants along a direction of advancing toward the cap 28 (a direction shown by an arrow in FIG. 7(*a*)), and the cap 28 is strongly pushed against the taper portion 52*a*. When the needle 51 is further moved in the state where a part of the cap 28 has entered into the through hole, the cap 28 entering into the through hole interferes with the inner surface of the through hole. In this case, the needle 51 does not smoothly enter into the cap 28. Furthermore, when the cap 28 interferes with the inner surface of the through hole, a shear force is applied to the cap 28. The cap 28 may be peeled off by the inner surface of the through hole.

In this embodiment, the through hole 55 is formed on the cylindrical portion 53, while the through hole 55 is not formed on the taper portion 52*a*. Thus, it is possible to prevent the cap 28 from being peeled off by the inner surface of the through hole.

FIG. 7(*b*) shows the state where the needle 51 is further moved in a direction shown by an arrow than the state in FIG. 7(*a*). In FIG. 7(*b*), the cap 28 has reached the outer slanted portion 61.

When the cap 28 reaches the outer slanted portions 61, a part 28*a* of the cap 28 enters into the outer slanted portion 61 due to the elastic rebound force. However, the cap 28 is hard to enter into the through hole 55. It is assumed that this event occurs for the following reason. When the needle 51 is moved in the axis direction, the outer slanted portion 61 pushes back the part 28*a* of the cap 28 against the elastic rebound force. That is, the outer slanted portion 61 pushes back the cap 28 to the side opposite to the needle 51.

In this embodiment, the cap 28 is hard to enter into the through hole 55. Thus, the cap 28 is hard to interfere with the inner surface of the through hole 55. The shear force applied to the cap 28 by the inner surface of the through hole 55 is suppressed. As a result, it is possible to make it harder for the cap 28 to be peeled off by the through hole 55.

Furthermore, in the case where the outer slanted portion 61 is formed, a corner between the inner surface of the through hole 55 and the outer slanted portion 61 becomes an obtuse angle. For this reason, it is possible to make it harder for the cap 28 to be peeled off by the corner between the inner surface of the through hole 55 and the outer slanted portion 61.

In the axis direction of the tubular member 52, the outer slanted portions 61 are formed on the both sides of the through hole 55. That is, in FIG. 7, the outer slanted portion 61 is formed on both of the right side and the left side of the through hole 55. Therefore, the above-mentioned effects can be obtained in both of a case where the needle 51 is inserted into the cap 28 and a case where the needle 51 is pulled out of the cap 28.

Since the needle 51 in this embodiment is provided with the outer slanted portions 61, it is possible to make it harder for the cap 28 to be peeled off by the through hole 55.

The outer slanted portion 61 is relatively long in the axis direction 81 of the tubular member 52 and relatively short in the circumferential direction of the tubular member 52. That is, t1 (see FIG. 4) is longer than t3 (see FIG. 6). Moreover, the sum of S1 and S2 is more than twice the sum of S3 and S4 (see FIG. 4). Since the outer slanted portion 61 is relatively long in the axis direction 81 of the tubular member 52, when the needle 51 moves in the axis direction 81, the outer slanted portion 61 can effectively push pack the cap 28. Since the outer slanted portion 61 is relatively short in the circumferential direction of the tubular member 52, it is possible to prevent the strength of the tubular member 52 in the circumferential direction from greatly lowering.

As described above, even when the outer slanted portions 61 are formed on the tubular member 52, the strength of the tubular member 52 in the circumferential direction is not greatly lowered. Thus, four outer slanted portions 61 (through holes 55) can be provided along the circumferential direction of the tubular member 52. Since a plurality of through holes 55 is provided, ink smoothly flows into the needle 51. Furthermore, it is assumed that the inner slanted portions 65 also help the ink smoothly flow into the needle 51.

Figure 8:
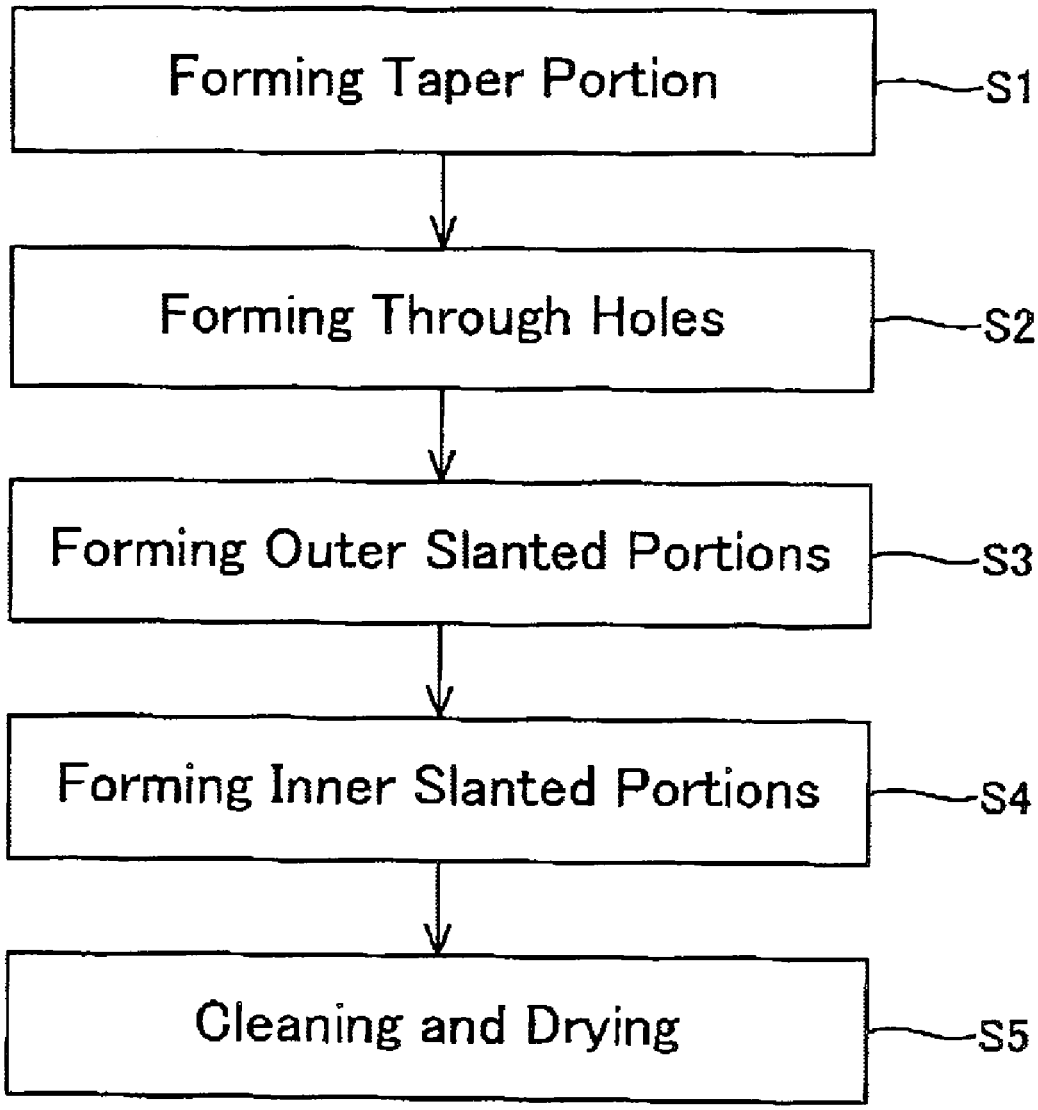
FIG. 8 shows a step of manufacturing the needle.

A method of manufacturing the needle 51 will be described. FIG. 8 is a flowchart showing the method of manufacturing the needle 51.

First, a cylinder hollow material is prepared. Both ends of this cylinder hollow material are not closed. In other words, the both ends of the cylinder hollow material are opened. One end of the cylinder hollow material is pressed from the outside in a radial direction while rotating the cylinder hollow material in the circumferential direction. Thus, the taper portion 52*a*, one end of which is closed (refer to FIG. 2), is formed on the cylinder hollow material (step S1). A portion of cylinder hollow material other than the taper portion 52*a* becomes the above-mentioned cylindrical portion 53 (refer to FIG. 2).

Subsequently, the cylindrical portion 53 is fixed with a jig. A drill is moved in a direction which is perpendicular to the axis direction of the cylinder hollow material. Thereby, perforating processing is performed. A plurality of through holes 55 (see FIG. 2) is formed on the cylindrical portion 53 (step S2). In this embodiment, twelve through holes 55 are formed on the cylindrical portion 53.

Subsequently, a drill having a larger diameter than the drill used at step S2 is prepared. A top portion of the large-diameter drill has a convex center part. The axis of the large-diameter drill and the center 82 of the through hole 55 (see FIG. 4) are positioned so that the both are arranged on the same axis. The rotating large-diameter drill is brought closer to the cylindrical portion 53. The large-diameter drill moves in a direction which is perpendicular to the axis direction of the cylinder hollow material. The large-diameter drill comes into contact with the outer side surface 53*a* of the cylindrical portion 53. Thus, the cylindrical portion 53 is scraped and cut, thereby the outer slanted portions 61 (see FIG. 2) is formed around the outer opening 55*a* of the through hole 55 (step S3). The outer opening 55*a* opens to the outer slanted portion 61. Since the top portion of the large-diameter drill is convex shape, the outer slanted portion 61 slants down toward the outer opening 55*a*.

The cylindrical portion 53 is curved in the circumferential direction. On the other hands the cylindrical portion 53 is not curved in the axis direction. When the cylindrical portion 53 is cut with the large-diameter drill, the portion which is curved in the circumferential direction is cut narrow, and the portion which is not curved in the axis direction is cut wide. Thus, the elliptic outer slanted portion 61 which is relatively long in the axis direction of the cylindrical portion 53 is formed (see FIG. 4). In the outer slanted portions 61, the length t1 (see FIG. 4) of the cylinder hollow material in the axis direction is greater than the length t3 (see FIG. 6) of the cylinder hollow material in the circumferential direction. In the outer slanted portions 61, the sum of the distance S1 and the distance S2 in FIG. 4 is more than twice the sum of the distance S3 and the distance S4. At step S3, the large-diameter drill capable of forming the outer slanted portions 61 with such configuration is used.

At step S3, the outer slanted portion 61 is formed around each through hole 55. In this embodiment, twelve outer slanted portions 61 are formed.

Next, step S4 is performed. First, an injector which can discharge liquid containing an abrasive is prepared. The cylinder hollow material prepared in step S1 has one end which is closed and the other end which is opened. The above-mentioned liquid is injected into the cylinder hollow material from the other end of the cylinder hollow material by the injector. The liquid injected into the cylinder hollow material is discharged to the outside of the cylinder hollow material from each through hole 55. During this process, corners between an inner surface of the cylinder hollow material and the inner surface of each through hole 55 are shaved by the abrasive. As a result, the inner slanted portion 65 is formed in the periphery of the inner opening 55*b* of each through hole 55 (see FIG. 5). The inner slanted portion 65 slants down toward the inner opening 55*b* of the through hole 55. According to the method, the inner slanted portions 65 can be easily formed.

When the through holes 55 are formed at step S2, burrs may occur in the periphery of the inner openings 55*b* of the through holes 55. When step S4 is performed, the burrs can be removed.

At step S5, an injector capable of discharging cleaning fluid is prepared. The cleaning fluid is injected into the cylinder hollow material from the other end of the cylinder hollow material by the injector. The leaning fluid injected into the cylinder hollow material is discharged to the outside of the cylinder hollow material from each through hole 55. In this manner, the inside of the cylindrical portion 53 and the taper portion 52*a* is cleaned. Next, the cleaning fluid is dried. Thus, the needle 51 is completed.

Modification examples of the above-mentioned embodiments will be described below.

Figure 9:
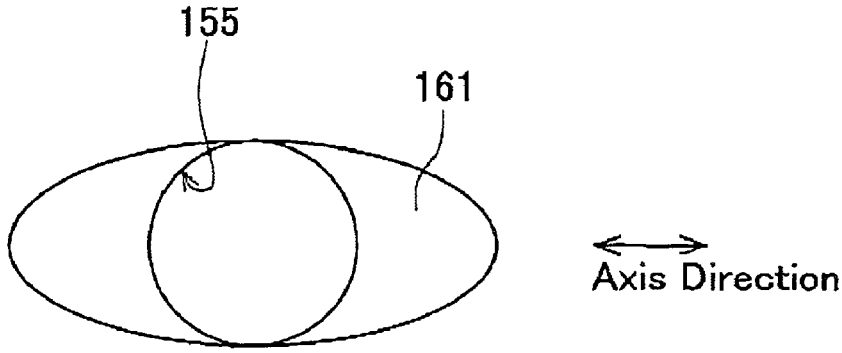
FIG. 9 shows a needle in a modification example.

(1) FIG. 9 shows a plan view of an outer slanted portion 161 in a modification example. FIG. 9 corresponds to FIG. 4 in accordance with the above-mentioned embodiment. In FIG. 9, an upper end of a through hole 155 is located at the same position as an upper end of the outer slanted portion 161, and a lower end of the through hole 155 is located at the same position as a lower end of the outer slanted portion 161. With this configuration, the strength of the tubular member in the circumferential direction can be further improved.

Figure 10:
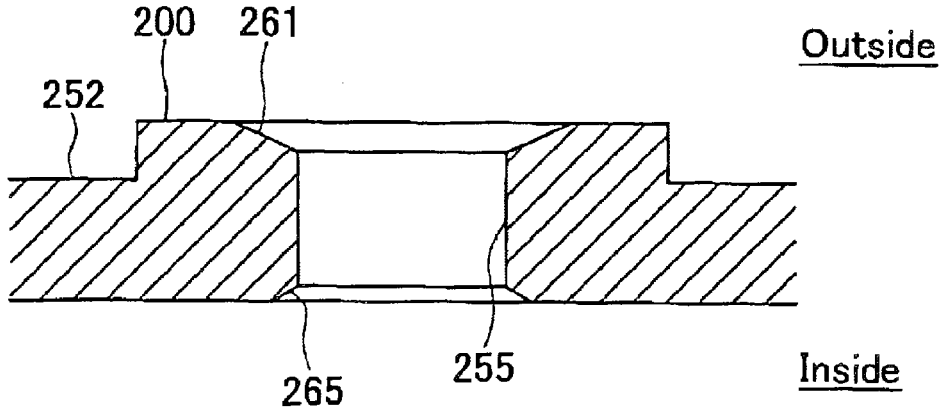
FIG. 10 shows a needle in another modification example.

(2) FIG. 10 shows a view for describing another modification example. FIG. 10 corresponds to FIG. 5 in accordance with the above-mentioned embodiment. In this modification example, a step portion 200 is formed on a tubular member 252. A through hole 255, an outer slanted portion 261, and an inner slanted portion 265 are formed at the positions corresponding to the step portion 200.

(3) In the above embodiment, the axis 82 of the through hole 55 is perpendicular to the axis 81 of the tubular member 52. However, the axis 82 of the through hole 55 is not necessarily perpendicular to the axis 81 of the tubular member 52.

(4) As shown in FIG. 4, the outer slanted portion 61 is elliptic shape. However, as long as the t1 is greater than the t2 and t3, the outer slanted portion 61 need not be elliptic shape. Even in this case, it is preferred that the sum of the S1 and the S2 is more than twice the sum of the S3 and the S4.

(5) The inner slanted portions 65 need not be formed.

(6) The taper portion 52*a* need not be formed.

(7) The through holes 55, the outer slanted portions 61, and/or the inner slanted portions 65 may be formed on the taper portion 52*a*.

(8) The tubular member 52 has a circular in the vertical cross section (see FIG. 3). However, the tubular member 52 has the other shapes. For example, a triangle, rectangular, polygonal or elliptic vertical may be adopted.

(9) The needle may be provided at the injector for injecting ink into the ink bag 21 in the ink cartridge 20. In this case, the needle penetrates the cap (not shown) of the spout 23*a* in FIG. 1. Thereby, the ink can be supplied to the ink bag 21 from the injector.

(10) The needle 51 need not be used in the ink jet printer 1. The needle 51 can be used for the other purposes.

(11) In the above-mentioned embodiment, the through holes 55 are formed using the drill. This can be modified as follows. For example, the through holes 55 may be formed by using a disk-like cutter.

(12) The outer slanted portions 61 may be formed by using a cutter for cutting a surface.

(13) Either of the step of forming the through holes 55 or the step of forming the outer slanted portions 61 may be performed first.

(14) Either of the step of forming outer slanted portions 61 or the step of forming the inner slanted portions 65 may be performed first.

(15) The needle 51 in this embodiment may be made of metal (stainless) or resin. The resin needle may be made using a mold. In this case, molds divided into plural parts may be utilized. The axis of the needle may be a center of the divided molds.

What is claimed is:

1. A needle comprising: a tubular member comprising a side wall, a through hole formed at the side wall, and an outer slanted portion formed at an outer surface of the side wall along the periphery of the through hole, wherein the outer slanted portion slants down toward the through hole, wherein a length of the outer slanted portion in an axis direction of the needle is greater than a length of the outer slanted portion in a circumferential direction of the needle.

2. The needle as in claim 1, wherein the through hole extends along a direction which is perpendicular to an axis of the needle.

3. The needle as in claim 1, wherein the through hole comprises an outer opening which opens to the outer slanted portion, a line which passes through a center of the outer opening and is perpendicular to an axis of the needle is a predetermined line, a plane which is perpendicular to the predetermined line is a predetermined plane, a first distance is greater than a second distance, the first distance is a distance of a portion where a first virtual line overlaps with the outer slanted portion within the predetermined plane, the first virtual line passes through the center of the outer opening and extends along the axis direction of the needle, the second distance is a distance of a portion where a second virtual line overlaps with the outer slanted portion within the predetermined plane, and the second virtual line passes through the center of the outer opening and extends along a direction which is perpendicular to the axis direction of the needle within the predetermined plane.

4. The needle as in claim 3, wherein the second distance is more than zero.

5. The needle as in claim 3, wherein the first distance is more than twice the second distance.

6. The needle as in claim 3, wherein the outer slanted portion has an elliptical shape within the predetermined plane, and the elliptical shape of the outer slanted portion is symmetrical with respect to the first virtual line and the second virtual line.

7. The needle as in claim 1, wherein one end of the tubular member is closed.

8. The needle as in claim 1, wherein the tubular member further comprises a taper portion which dwindles toward one end of the tubular member.

9. The needle as in claim 8, wherein the though hole and the outer slanted portion are formed at an area except the taper portion.

10. The needle as in claim 9, wherein the tubular member comprises a plurality of through holes formed at the side wall and a plurality of outer slanted portions formed at the outer surface of the side wall, each outer slanted portion corresponds to different one of the through holes, each outer slanted portion is formed along the periphery of a corresponding through hole, each outer slanted portion slants down toward the corresponding through hole, and the through holes and the outer slanted portions are formed at the area except the taper portion.

11. The needle as in claim 10, wherein the outer slanted portions are disposed in a symmetrical pattern with respect to an axis of the needle.

12. The needle as in claim 1, wherein the tubular member further comprises an inner slanted portion formed at an inner surface of the side wall along the periphery of the through hole, the inner slanted portion slants down toward the though hole.

13. The needle as in claim 1, wherein the needle is utilized for penetrating an elastic body which blocks an opening of a fluid housing body.

14. The needle as in claim 13, wherein the fluid housing body is an ink cartridge which houses ink.

15. An ink jet printer, comprising: an ink jet head for discharging ink toward a print medium; a space for housing an ink cartridge, wherein ink within the ink cartridge is supplied to the ink jet head; and the needle as in claim 1 which is located at a position facing the space, wherein the needle is utilized for penetrating an elastic body which blocks an opening of the ink cartridge.

16. A needle comprising: a tubular member comprising a side wall, a through hole formed at the side wall, and an outer slanted portion formed at an outer surface of the side wall along the periphery of the through hole, wherein the outer slanted portion slants down toward the through hole, wherein the through hole comprises an outer opening which opens to the outer slanted portion, a line which passes through a center of the outer opening and is perpendicular to an axis of the needle is a predetermined line, a plane which is perpendicular to the predetermined line is a predetermined plane, a first distance is greater than a second distance, the first distance is a distance of a portion where a first virtual line overlaps with the outer slanted portion within the predetermined plane, the first virtual line passes through the center of the outer opening and extends along the axis direction of the needle, the second distance is a distance of a portion where a second virtual line overlaps with the outer slanted portion within the predetermined plane, and the second virtual line passes through the center of the outer opening and extends along a direction which is perpendicular to the axis direction of the needle within the predetermine plane.

17. An ink jet printer, comprising: an ink jet head for discharging ink toward a print medium; a space for housing an ink cartridge, wherein ink within the ink cartridge is supplied to the ink jet head; and the needle as in claim 16 which is located at a position facing the space, wherein the needle is utilized for penetrating an elastic body which blocks an opening of the ink cartridge.

* * * * *